US006426969B2

(12) United States Patent
Fontana

(10) Patent No.: US 6,426,969 B2
(45) Date of Patent: Jul. 30, 2002

(54) DISCHARGE SCREW FOR MOVING HEARTH

(75) Inventor: Piergiorgio Fontana, Genoa (IT)

(73) Assignee: SMS Demag S.p.A., Genon (IT)

( * ) Notice: Subject to any disclaimer, the term of this patent is extended or adjusted under 35 U.S.C. 154(b) by 0 days.

(21) Appl. No.: 09/900,922

(22) Filed: Jul. 10, 2001

(30) Foreign Application Priority Data

Jul. 12, 2000 (IT) ..... GE00A0095

(51) Int. Cl.[7] ..... H05B 7/00; F27D 3/08

(52) U.S. Cl. ..... 373/20; 373/72; 373/79; 432/198; 432/236

(58) Field of Search ..... 373/20, 72, 79, 373/83, 85; 432/236, 198

(56) References Cited

U.S. PATENT DOCUMENTS

| | | | | |
|---|---|---|---|---|
| 5,350,051 A | | 9/1994 | Cooper et al. | |
| 5,863,197 A | * | 1/1999 | Boy et al. | 432/236 |
| 6,213,762 B1 | * | 4/2001 | Eichberger et al. | 432/98 |

FOREIGN PATENT DOCUMENTS

| | | |
|---|---|---|
| DE | 195 39 841 C1 | 10/1995 |
| EP | 0 874 207 A1 | 10/1998 |
| FR | 1.359.814 | 3/1964 |
| FR | 2 546 806 | 12/1984 |
| JP | 2000111264 | 4/2000 |

* cited by examiner

*Primary Examiner*—Tu Ba Hoang
(74) *Attorney, Agent, or Firm*—Larson & Taylor

(57) ABSTRACT

Discharge screw (6) for a moving hearth, and in particular for an annular rotary hearth (2) of a reheat furnace for the heat treatment of loose materials, comprising a cylinder (61) arranged above and substantially radially with respect to this annular hearth (2) and turned by suitable actuators (15) so as to discharge the materials from the edges of this annular hearth (2); this cylinder (61) comprises on its lateral surface a first series of helicoids (62) beginning in an area close to its outermost end with respect to the furnace and a second series of helicoids (63) beginning at its innermost end with respect to the furnace; the inclination of the helicoids (62) of this first series is essentially symmetrical to the inclination of the helicoids (63) of this second series; and in this screw (6) each helicoid (62, 63) of one series comprises an inward end that meets the inward end of a corresponding helicoid (63, 62) of the other series in such a way that at at least one of the abovementioned ends a free final section is left for the removal of loose materials from an area underneath it on the annular hearth (2).

5 Claims, 2 Drawing Sheets

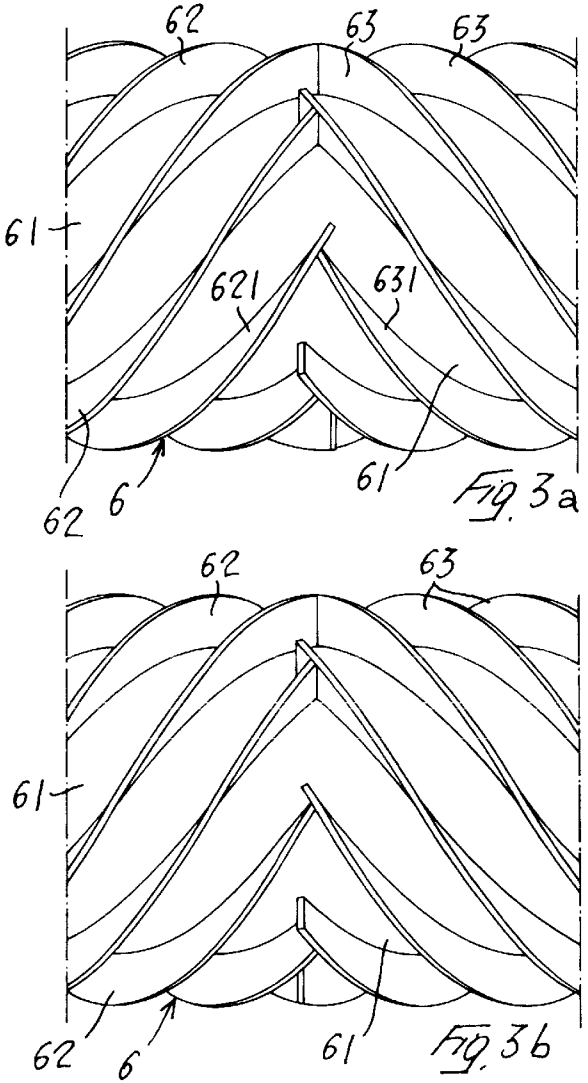
Fig. 3a
Fig. 3b
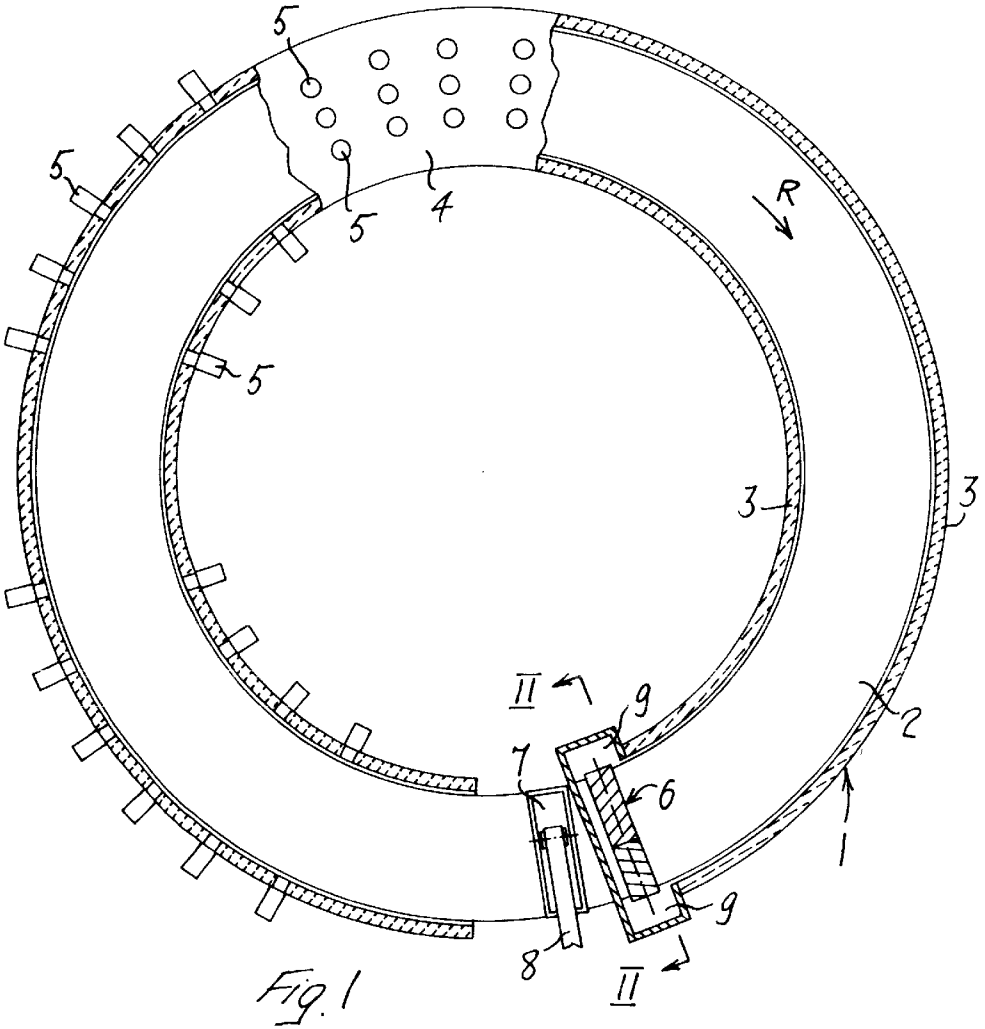
Fig. 1

DISCHARGE SCREW FOR MOVING HEARTH

The present invention relates to a discharge screw for discharging loose materials from a moving hearth, such as annular and rotary hearths for reheat furnaces, straight horizontal or inclined conveyor belts, or the like.

In particular, the present description will refer by way of non-restrictive example to a discharge screw used in a reheat furnace having an annular rotary hearth for treating loose materials, such as minerals in pellet form subjected to an oxidation-reduction heat treatment.

As is known, these reheat furnaces comprise a toroidal chamber with an annular hearth that rotates with respect to the rest of the chamber, and two side walls and an upper wall, with a plurality of burners arranged on these walls. The pellets are introduced onto the surface of this annular hearth and must be thermally treated by the heat supplied by the burners: the pellets, after performing approximately one revolution of the furnace under the action of the said burners, arrive upstream of a screw which is positioned radially above the hearth. The rotation of the said screw causes the pellets to be discharged onto one or both sides of the said hearth. For discharge onto both sides of the hearth, one possibility is to use a rotary screw consisting of a cylinder comprising on its lateral surface a first series of helicoids beginning in an area close to its outermost end with respect to the furnace and a second series of helicoids beginning at its innermost end with respect to the furnace. The inclination of the helicoids of the first series is essentially symmetrical to the inclination of the helicoids of the second series. These two series of helicoids meet approximately in a transverse plane near the centre of the cylinder and on this plane the said helicoids come together exactly.

There are drawbacks to these screws with helicoids whose inward ends meet and come together in a transverse plane with respect to the cylinder: during treatment in the furnace, the pellets occupy virtually the whole of the surface of the rotary hearth and, as they arrive upstream of the discharge screw, those positioned beneath the meeting point of the helicoids are not discharged efficiently, causing an accumulation of material which progressively builds up, because the material is being continually fed in at the loading area downstream of the screw.

The object of the present invention is to provide a discharge screw for a moving hearth, and in particular for a rotary hearth in a reheat furnace, that will overcome the abovementioned drawbacks of known screws.

This object is achieved by the present invention in the form of a discharge screw for a moving hearth, and in particular for an annular rotary hearth of a reheat furnace for the heat treatment of loose materials, comprising a cylinder arranged above and substantially radially with respect to this annular hearth and turned by suitable actuators so as to discharge the materials from the edges of this annular hearth; this cylinder comprises on its lateral surface a first series of helicoids beginning in an area close to its outermost end with respect to the furnace and a second series of helicoids beginning at its innermost end with respect to the furnace; and the inclination of the helicoids of this first series is essentially symmetrical to the inclination of the helicoids of this second series; in this screw, each helicoid of one series comprises an inward end that meets the inward end of a corres-ponding helicoid of the other series in such a way that at at least one of the abovementioned ends a free final section is left for the removal of loose materials from an area underneath it on the annular hearth.

Other objects and advantages of the present invention will become clearer in the course of the following description, considered by way of non-limiting examples with reference to the attached drawings, in which:

FIG. 1 shows a plan view, partly in section, of a rotary-hearth reheat furnace;

Figure 2:
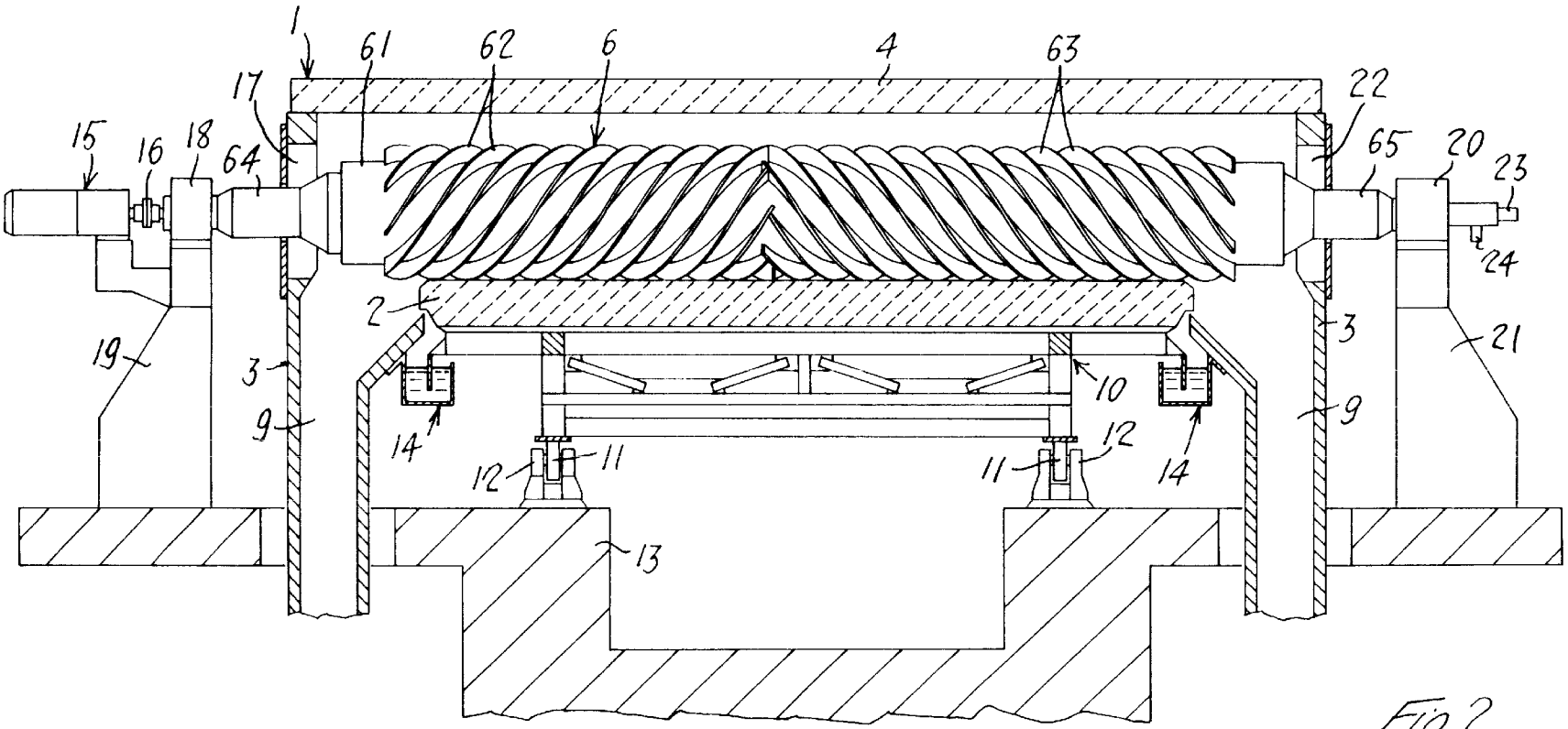
FIG. 2 shows a view of a cross section through the furnace taken on II—II in FIG. 1, in which can be seen a first embodiment of a discharge screw according to the present invention.

FIG. 3*a* shows an enlarged partial view of the discharge screw in the embodiment shown in FIG. 2; and FIG. 3*b* shows a partial view of a second embodiment of the screw according to the present invention.

With reference to FIG. 1, this illustrates a reheat furnace for the heat treatment of loose materials in pellet form. This furnace consists of a toroidal chamber 1 comprising on the bottom an annular hearth 2 rotating in the direction of arrow R, two side walls 3 and an upper wall 4 or roof of the furnace. On the side walls 3 and on the roof 4 of the furnace are a series of burners 5 whose job is to supply the interior of the chamber 1 with the heat necessary for the heat treatment of the pellets. These pellets are poured onto the annular hearth 2 through a loading hopper 7 supplied by a conveyor belt 8 and execute approximately one complete revolution of the toroidal chamber 1 in the direction of arrow R until they reach the rotating discharge screw 6. This rotating screw 6 discharges the treated pellets onto both sides of the furnace via two hoppers 9.

FIG. 2 illustrates a cross section through the toroidal chamber 1 taken on II—II shown in FIG. 1. As can be seen, the annular hearth 2 is mounted on a supporting structure 10 integral with the said hearth as it rotates on wheels 11, each provided with bearings 12 mounted on the base 13 of the furnace. Externally, moreover, this structure 10 comprises sealing systems 14 to prevent the escape of fumes present in the toroidal chamber 1 during the treatment of the pellets. On the upper surface of the annular hearth 2 and in a radial direction with respect to this hearth is the discharge screw 6. This screw 6 consists of a cylinder 61 on which are formed two series of helicoids 62 and 63: the helicoids 62 begin near the outermost end of the cylinder 61 with respect to the furnace and the helicoids 63 begin at the innermost end. As can be seen, the angle of inclination of the helicoids 62 is symmetrical, with respect to a plane passing transversely through the cylinder 61, to the angle of inclination of the helicoids 63. The screw 6 is driven by actuators 15 external to the toroidal chamber 1 and connected by a coupling 16 to one end 64 of the said screw 6 projecting from an aperture 17 formed in the outer side wall 3 of the chamber 1. This end 64 is supported by a bearing 18 connected to a support 19 mounted on the furnace base 13. On the inward side of the chamber 1 the screw 6 comprises an end 65 projecting from an aperture 22 formed in the innermost side wall 3 of the said chamber 1 and is supported by its own bearing 20 connected to a support 21 mounted on the furnace base 13. Because of the fact that, in the treatment of the materials, the atmosphere in the chamber 1 can reach very high temperatures, a water-based cooling system is provided inside the cylinder 61, for which two pipes 23 and 24 can be seen for admission and exit, respectively, of the cooling water from the inside of the screw 6.

FIG. 3*a* shows an enlarged view of the central portion of the screw 6, in which the inward ends of the helicoids 62 and 63 meet. In known screws these ends come together on a plane passing transversely through the cylinder 61, whereas, as can be seen in the figure, in the present screw 6 the inward ends of the helicoids 62 and 63 overlap each other alternately: take for example helicoid 621, which comprises a final section that extends beyond the inward final end of the corresponding helicoid 631 in such a way as to efficiently remove materials that would otherwise accumulate in an area underneath it on the hearth 2 during discharging. Likewise, the other helicoids 62 and 63 comprise free sections that extend beyond the ends of the corresponding helicoids, which are symmetrical about a plane passing transversely through the cylinder 61.

FIG. 3*b* shows a variant of the present screw 6, in which all of the inward ends of the helicoids 63 extend beyond the inward ends of the corresponding helicoids 62, each helicoid 63 thus being provided with a free final section.

The present screw 6 operates in the following manner: the screw 6 is rotated by the actuators 15, while the material to be treated is loaded from the belt 8 down-stream of the said screw onto the hearth 2, which is itself rotated in direction R. The material makes practically one complete revolution of the chamber 1 and arrives upstream of the screw 6 which will divide it into two discharge hoppers 9. In particular, when considering FIG. 2, helicoids 62 will push the material towards the left-hand and outermost hopper with respect to the furnace, while helicoids 63 will push the material towards the right-hand and innermost hopper 9 of the furnace, thus emptying the hearth 2 on which the material had been uniformly distributed. The overlapping of the inward ends of the helicoids 62 and 63, whether alternately (FIG. 3*a*) or not (FIG. 3*b*), causes the material to be discharged efficiently even from the central areas of the hearth, in which, with known screws, the material normally accumulates and fails to be removed.

Lastly, it should be emphasised that the present screw could also be used, in exactly the same way as described above, for discharging loose material from both sides of a straight conveyer belt, preventing the accumulation of the said material in its central area.

What is claimed is:

1. Discharge screw (6) for a moving hearth, and in particular for an annular rotary hearth (2) of a reheat furnace for the heat treatment of loose materials, comprising a cylinder (61) arranged above and substantially radially with respect to the said annular hearth (2) and turned by suitable actuators (15) so as to discharge the materials from the edges of the said annular hearth (2), the said cylinder (61) comprising on its lateral surface a first series of helicoids (62) beginning in an area close to its outermost end with respect to the furnace and a second series of helicoids (63) beginning at its innermost end with respect to the furnace, and the inclination of the helicoids (62) of the said first series being essentially symmetrical to the inclination of the helicoids (63) of the said second series, which screw is characterized in that each helicoid (62, 63) of one series comprises an inward end that meets the inward end of a corresponding helicoid (63, 62) of the other series in such a way that at at least one of the said ends a free final section is left for the removal of loose materials from an area underneath it on the annular hearth (2).

2. Discharge screw (6) according to claim 1, characterized in that the inward ends, near the centre of the cylinder (61), of a series of helicoids (63) extend beyond the corresponding inward ends of the other series of helicoids (62).

3. Discharge screw (6) according to claim 1, characterized in that the inward ends, near the centre of the cylinder (61), of a series of helicoids (62, 63) meet and extend alternately beyond the corresponding inward ends of the other series of helicoids (63, 62).

4. Discharge screw (6) according to claim 1, characterized in that the inward ends of both series of helicoids (62, 63) are positioned in an area close to a transverse mid-plane of the cylinder (61).

5. Discharge screw (6) according to claim 1, characterized in that the outward ends of the helicoids (62, 63) are positioned beyond the outermost and innermost edges of the annular rotary hearth (2).

* * * * *